United States Patent [19]

Calabrese

[11] 4,456,249

[45] Jun. 26, 1984

[54] STRETCHING APPARATUS

[76] Inventor: John Calabrese, 3603 Greengarden Blvd., Erie, Pa. 16508

[21] Appl. No.: 497,274

[22] Filed: May 31, 1983

[51] Int. Cl.[3] ..... A63B 23/00

[52] U.S. Cl. ..... 272/139; 272/126

[58] Field of Search ..... 272/126, 134, 136, 137, 272/143, 139, 94–96, 119–121, 116, 125; 128/25 R

[56] References Cited

U.S. PATENT DOCUMENTS

| | | | |
|---|---|---|---|
| 1,701,747 | 2/1929 | Dobbins | 272/126 |
| 3,752,474 | 8/1973 | Macabet et al. | 272/126 |
| 3,999,752 | 12/1976 | Kupperman et al. | 272/143 |

FOREIGN PATENT DOCUMENTS

| | | | |
|---|---|---|---|
| 356572 | 10/1920 | Fed. Rep. of Germany | 272/126 |
| 498504 | 12/1927 | Fed. Rep. of Germany | 272/139 |
| 1192960 | 5/1965 | Fed. Rep. of Germany | 272/126 |
| 18341 | of 1908 | United Kingdom | 272/142 |

*Primary Examiner*—Richard J. Apley
*Assistant Examiner*—Chris Coppens
*Attorney, Agent, or Firm*—Ralph Hammar

[57] ABSTRACT

A self-contained stretching apparatus with two ropes extending from a collar fitting over the head or neck to a foot receiving stirrup. Each rope has a separate handgrip. By putting one foot in the stirrup and pulling the handgrips, various muscles and tendons may be stretched as part of a warming up exercise.

2 Claims, 9 Drawing Figures

STRETCHING APPARATUS

BACKGROUND OF THE INVENTION

This invention is intended to improve the "warming up" exercise by a self-contained stretching apparatus which stretches various muscles and tendons under the control of the user.

DESCRIPTION OF THE PREFERRED EMBODIMENT

Figure 2:
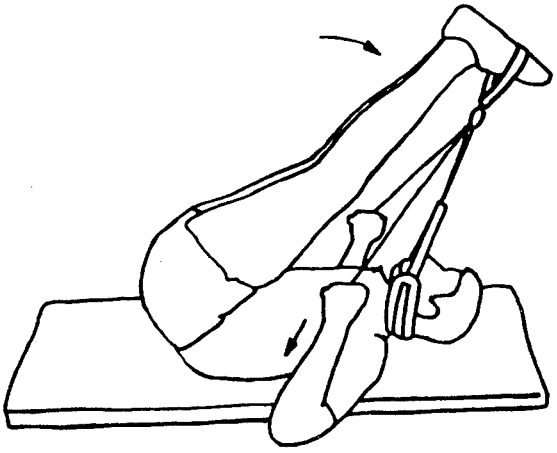
FIGS. 2–9 illustrate various exercises.
Figure 1:
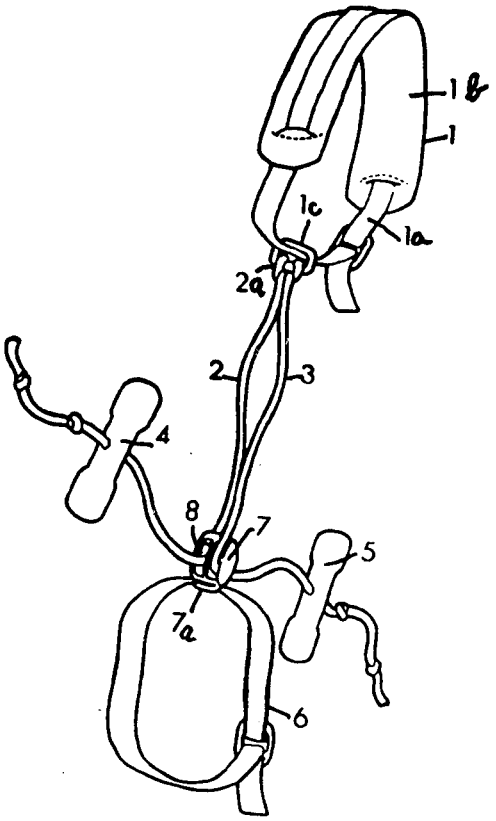
FIG. 1 is an elevation of the apparatus.

The apparatus consists of a head or neck collar 1, two ropes 2, 3, two handgrips 4, 5, and a single stirrup 6.

The collar comprises an adjustable strap 1*a* and a pad 1*b* for engaging the head or neck. The collar has a diameter much greater than the head or neck. The strap may be polypropylene webbing.

The ropes 2, 3 are secured to the collar by a ring 1*c* loosely received on the strap. Whenever the ropes are tensioned, the ring slides so the pull of the ropes on the strap is centered. In the particular construction shown, the ropes 2, 3 are opposite ends of a single length of rope, and a loop 2*a* is inserted through the ring 1*a* and the free ends of ropes 2, 3 are inserted through the projecting end of the loop. When the free ends are pulled tight through the loop, both ropes 2, 3 are fixed to the ring 1*c* and when the device is used, the tension in the ropes centers the ring 1*c* on the collar so the tension of the ropes acts in a plane through the center of the collar. Polypropylene ropes are preferred.

The stirrup 6 may be an adjustable loop of flexible polypropylene strapping similar to the collar 1, but without the pads. Normally the stirrup receives only one foot, but it will receive both feet easily with room to spare.

Tension from the ropes 2, 3 could be transferred to the stirrup by a ring similar to ring 1*c* used for the collar. This structure has the objection that friction between the ropes and the ring may cause overheating. A convenient commercially available antifriction structure is the pulley block 7 with two loose pulleys 8, one for each rope, and an eye 7*a* at the bottom slidably receiving the stirrup 6. The ropes 2, 3 each run over a separate pulley. A pull or tension force on the handgrips 4, 5 in any direction goes directly to the collar 1 through ropes 2, 3 and ring 1*c*. The handgrips may be adjustably positioned on the ropes. The tension force in the ropes 2, 3 also acts through pulleys 8 to lift pulley block 7 and thereby tension stirrup 6 which passes through the eye 7*a* on the lower end of the pulley block.

Figure 4:
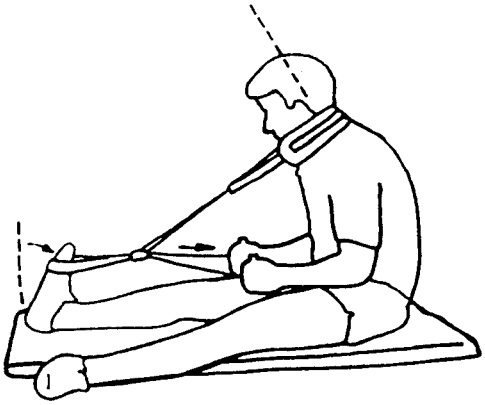
Figure 3:
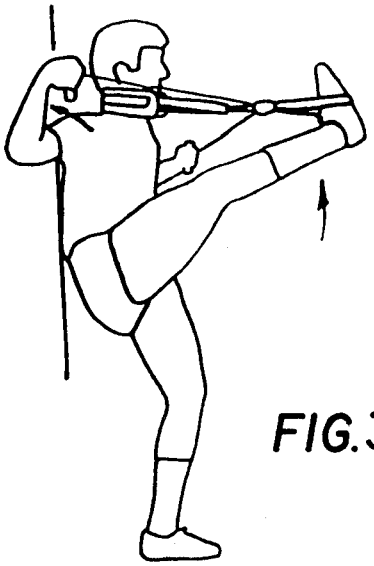
Figure 5:
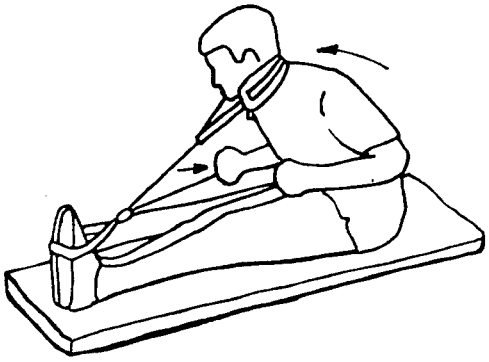
Figure 6:
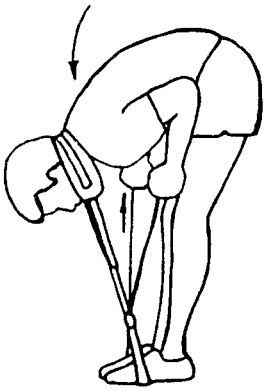
Figure 7:
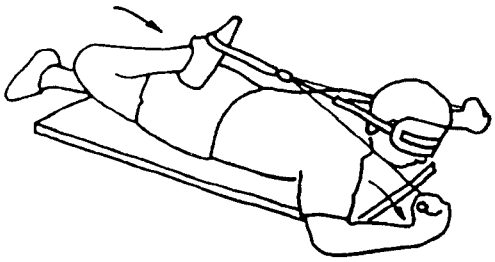
Figure 8:
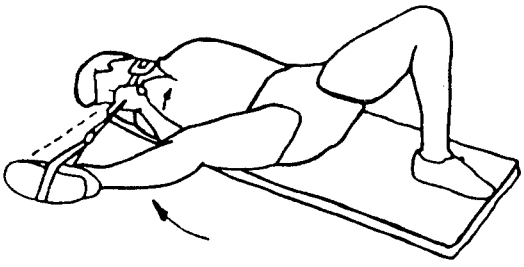
Figure 9:
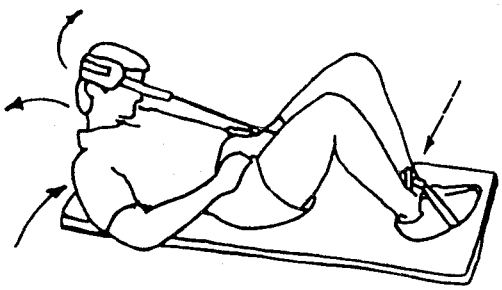

In the use of the device, shown in FIGS. 2–9, it is expected that muscles and tendons will be stretched by movement beyond usual positions and that the user will become more limber. Athletes and ballet dancers use the stretching apparatus for a quicker and more thorough warm up. Athletes who use the apparatus are less susceptible to injury.

The apparatus allows the athlete to stretch all major tendon groups in a manner which includes constant stretch in a mild and controlled manner and does not perform stretching with the bounce technique which should be avoided.

If athletes would use such a device daily in order to keep all muscle groups supple, the occurrence of straintype injuries and overuse patterns would greatly and rapidly decrease.

The apparatus is self-contained—it can be used anywhere. No installation is required.

The apparatus is not intended for muscle development. Tensing or overstressing muscles is avoided.

The use of the apparatus is further explained in the following directions for exercises 2–9 illustrated by correspondingly numbered figures.

2. Lower Back:

Lying flat on back with legs at a 90° angle to the ground, place one or both feet in foot stirrup. Hold head firmly on ground. Pull handles toward upper body until leg(s) extend(s) over head.

3. Back of Knee; Hamstring:

Stand erectly with back against firm surface. Place one foot in foot stirrup. Raise leg, keeping knee straight. Pull handles toward upper body.

4. Achilles Tendon; Calf:

Sitting position, keeping back straight, using neck as a post. Place foot strirrup on upper portion of foot. Pull handles toward upper body.

5. Hamstrings; Lower Back:

Sitting position, keeping back straight, using neck as a post. Place one or both feet in foot stirrup. Pull handles toward upper body while simultaneously moving head toward feet.

6. Repeat Exercise 5 standing at a 90° angle.

7. Quadriceps:

Lying on stomach, place neck pad on forehead. Keep forehead firmly on ground. Place foot in foot stirrup. Pull handles toward head.

8. Groin:

Lying on back, place right foot in foot stirrup. Grasp both handles with right hand. Extend leg to right side of body while simultaneously turning head to right side. Pull handles toward chin. Repeat on left side.

9. Mid Back; Neck:

Lying on back, keeping knees bent, place neck pad on upper portion of head. Place both feet in foot stirrup. Tilt head forward until chin meets chest while simultaneously extending feet to keep rope taut. Be sure to keep heels on ground. Move head left to right.

I claim:

1. Self-contained stretching apparatus comprising a first flexible strap loop or collar fitting over the head or neck, a first ring slidably mounted on said first loop, two ropes, each having one end fixed to the first ring, a second flexible strap loop forming a foot receiving stirrup, a second ring adjustably mounted on and forming a tension connection to said second loop, a right handgrip connected to the other end of one rope, said one rope having its midsection running through said second ring, a left handgrip connected to the other end of the other rope, said other rope having its midsection running through said second ring whereby pulling on the handgrips regulates the tension in the ropes between said first and second loops.

2. Self-contained stretching apparatus comprising a first flexible strap loop or collar fitting over the head or neck, a first ring slidably mounted on said first loop, two ropes, each having one end fixed to the first ring, a pulley block having two loose pulleys, a right handgrip connected to the other end of one rope, said one rope having its midsection running over one of said pulleys, a left handgrip connected to the other end of the other rope, said other rope having its midsection running over the other of said pulleys, a foot receiving stirrup, and a tension connection between the pulley block and stirrup whereby the tension between said first loop and said stirrup is regulated by pulling said handgrips.

* * * * *